US007175382B2

(12) United States Patent
Betti et al.

(10) Patent No.: US 7,175,382 B2
(45) Date of Patent: Feb. 13, 2007

(54) DEVICE AND METHOD FOR SEPARATING PACKS OF LAMINAR PRODUCTS FROM ONE ANOTHER

(75) Inventors: Giulio Betti, Lucca (IT); Angelo Benvenuti, Lucca (IT); Alessandro Morelli, Luca (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 10/344,579

(22) PCT Filed: Aug. 7, 2001

(86) PCT No.: PCT/IT01/00439

§ 371 (c)(1),
(2), (4) Date: Mar. 20, 2003

(87) PCT Pub. No.: WO02/14196

PCT Pub. Date: Feb. 21, 2002

(65) Prior Publication Data

US 2004/0035681 A1 Feb. 26, 2004

(30) Foreign Application Priority Data

Aug. 14, 2000 (IT) ..... FI2000A0182

(51) Int. Cl.
*B65G 57/00* (2006.01)

(52) U.S. Cl. ..... 414/789.5; 414/789.9

(58) Field of Classification Search ..... 414/789.5, 414/789.9; 271/218
See application file for complete search history.

(56) References Cited

U.S. PATENT DOCUMENTS

| | | | | |
|---|---|---|---|---|
| 4,162,649 | A * | 7/1979 | Thornton | 414/790.8 |
| 4,508,333 | A * | 4/1985 | Byrt | 271/218 |
| 4,796,879 | A * | 1/1989 | Martini et al. | 271/218 |
| 4,938,465 | A * | 7/1990 | Marsiletti | 270/58.34 |
| 5,145,159 | A * | 9/1992 | Vits | 270/58.33 |
| 5,281,082 | A * | 1/1994 | Ghilardi | 414/798.9 |
| 6,120,240 | A * | 9/2000 | Ghilardi | 414/798.9 |

FOREIGN PATENT DOCUMENTS

| | | | |
|---|---|---|---|
| EP | 0 240 691 A1 | | 10/1987 |
| GB | 1018235 | | 1/1966 |
| WO | WO 97/28076 | * | 8/1997 |

* cited by examiner

*Primary Examiner*—Patrick Mackey
*Assistant Examiner*—Matthew J. Kohner
(74) *Attorney, Agent, or Firm*—Breiner & Breiner, LLC.

(57) ABSTRACT

The device comprises a guide (23) defining a closed for a plurality of separator fingers (15). In the vicinity of the end of the advance stretch of the guide is set a separating member (101) provided with a movement of insertion and extraction (f103) with respect to the pile of products (P, P1, P2), synchronized with the movement of advance of the products along the path of advance, so as to insert itself between two contiguous packs of laminar products (M1, M2), between which is inserted a respective separator finger (15), and to withhold temporarily the pile of laminar products whilst said separator finger (15) is moved away from the path of advance.

30 Claims, 10 Drawing Sheets

DEVICE AND METHOD FOR SEPARATING PACKS OF LAMINAR PRODUCTS FROM ONE ANOTHER

TECHNICAL FIELD

The present invention relates to a device for separating packs of laminar products from one another, for example packs of paper serviettes produced by a folding machine. The invention relates also to a corresponding method for separating packs of laminar products from one another, as well as a folding machine which incorporates said device and which implements said method.

BACKGROUND ART

From WO-A-9728076 a device is known for dividing a pile of laminar products into packs and for separating said packs from one another, said device comprising a path of advance for the pile of laminar products and, along said path of advance, a pair of guides defining respective closed paths along which pairs of separator fingers are made to advance. Each guide has an advance stretch and a return stretch, where at least the advance stretch is substantially parallel to the path of advance of the pile of laminar products. In order to separate two adjacent packs of products from one another in the unloading area and thus to enable separate and individual unloading of each pack, while holding back the subsequent pack, this known device envisages a system which, in the unloading area, causes temporary divarication of the two fingers making up each pair. In this way, the most advanced pack in the pile is moved away from the next, and is then unloaded. This known device is particularly effective, simple to build and reliable, especially as compared to the devices known previously. However, the pairs of fingers and the mechanism that causes their divarication in the area for unloading the packs of serviettes may, under certain working conditions, require relatively frequent maintenance interventions to eliminate the dust that may lead to jamming.

OBJECTS AND SUMMARY OF THE INVENTION

The object of the present invention is to provide a device that is even simpler and more reliable than prior devices.

The above and further objects and advantages, which will emerge clearly for persons skilled in the art from the ensuing text, are basically achieved by means of a device in which it is envisaged that, in the vicinity of the end of the advance stretch of the guide where the separator fingers (which are, in this case, single, and not double) slide, there is set a separating member provided with a movement of insertion and extraction with respect to the pile of products that is moving forward along the path of advance. The movement of the separating member is synchronized with the movement of advance of the products along the path of advance, so that the separating member is inserted between two contiguous packs of laminar products, between which a respective separator finger is inserted. In this way, the separating member withholds the pile of laminar products temporarily, whilst the separator finger is moved away from the path of advance and the first pack in the pile can be unloaded. At the same time, a retention member for holding back the front face of the next pack is introduced.

Basically, thanks to the present invention, a method can be implemented for separating adjacent packs of laminar products, which comprises the steps of:

temporarily inserting, between one pack and the next, between which a separator finger is set, a separating member;

causing a divarication between said pack and the next pack, moving away said separator finger and temporarily withholding the next pack by means of the separating member;

introducing a front-retention member, for example a moving blade, in front of the next pack; and sliding out the separating member.

The device that is thus obtained is simpler, and consequently more reliable, than the previously known devices, in so far as a single separating member (or else, two symmetrical separating members set on either side of the path of advance) in a fixed position with respect to the direction of advance of the products performs, in combination with the individual separator finger, the function previously performed by pairs of fingers. In this way, the number of components of the device is reduced, and reciprocally moving parts, which might get jammed on account, for instance, of the large amount of dust frequently present in plants for producing this type of paper articles, are eliminated.

Further advantageous characteristics and embodiments of the device and method according to the invention are described in what follows and are defined in the attached claims.

BRIEF DESCRIPTION OF THE DRAWINGS

A better understanding of the invention will be obtained by following the description and the attached drawings illustrating a possible, non-limiting, embodiment of the invention. More in particular, in drawings.

DETAILED DESCRIPTION OF THE PREFERRED EMBODIMENT OF THE INVENTION

Figure 1:
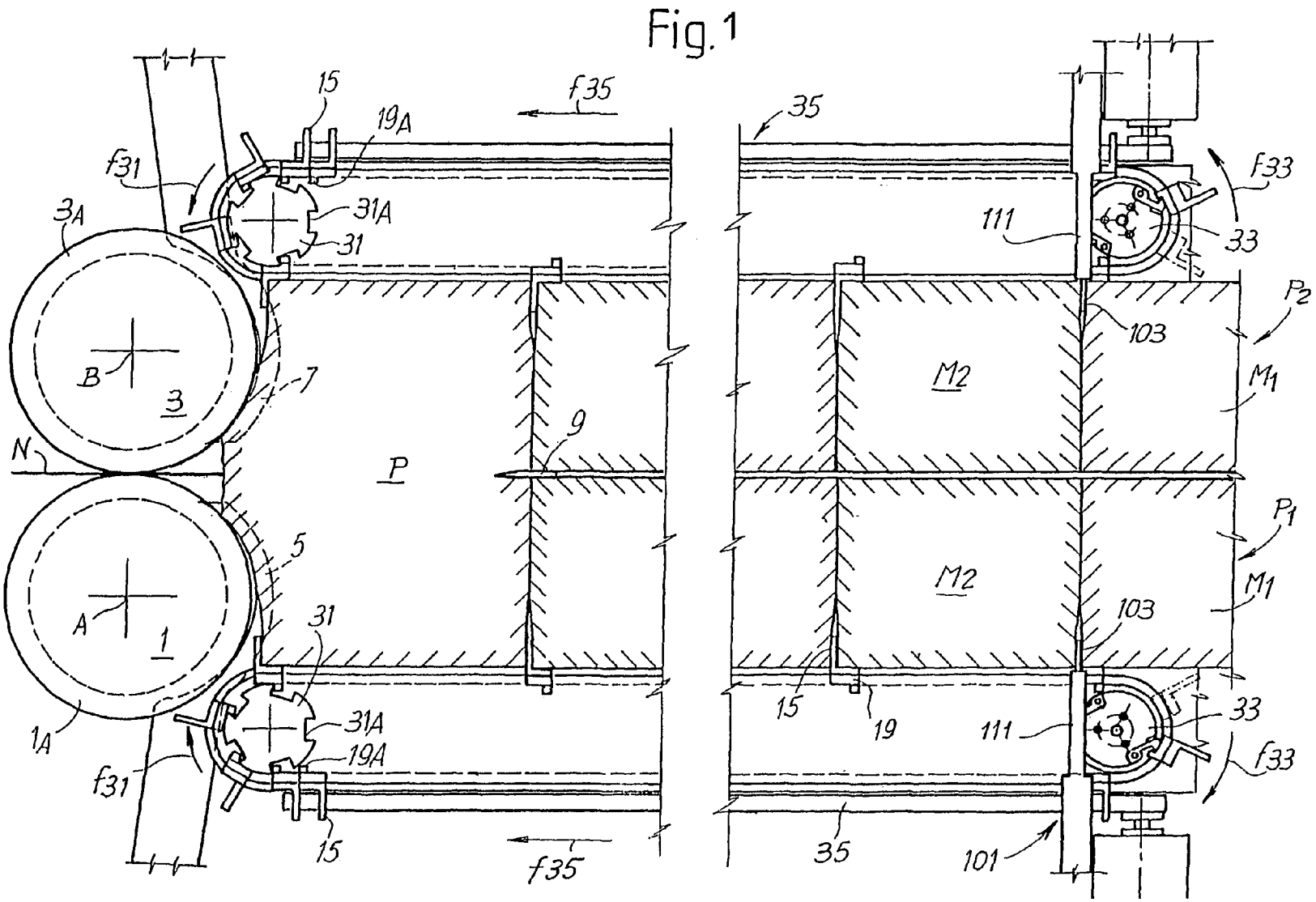
FIG. 1 is a plan view of a folding machine comprising a device according to the invention.

In the attached drawings, and with reference first in particular to FIG. 1, the reference numbers 1 and 3 designate two folding rollers of a folding machine for forming a pile P of serviettes or other folded laminar products. The folding rollers 1 and 3, which rotate about two vertical axes A and B, have annular grooves 1A and 3A within which arched arms 5 and 7 are housed, which detach the folded material from the respective roller and push it against the pile P of products already formed as they come out of the machine. A continuous weblike material N, possibly folded along a longitudinal line, is fed into the nip defined between the two rollers 1 and 3, associated to which are systems of a type in itself known, which fold the material coming out of the nip once about the roller 1 and once about the roller 3 to produce a pile of material folded in a zigzag fashion. At each fold, the respective arched arm 5 or 7 detaches the material from the roller and pushes it towards the pile P already formed.

Operation of the folding machine briefly described above is in itself known and will hence not be illustrated in greater detail herein.

The pile P of folded weblike material is pushed against a transverse blade 9, which cuts the pile into two parts P1 and P2, each made up of a plurality of serviettes folded into two or into four. Set downstream of the blade 9 is a partition wall, which keeps the two parts P1 and P2 into which the pile has been cut separate from one another, so enabling independent manipulation of the two parts.

Figure 7:
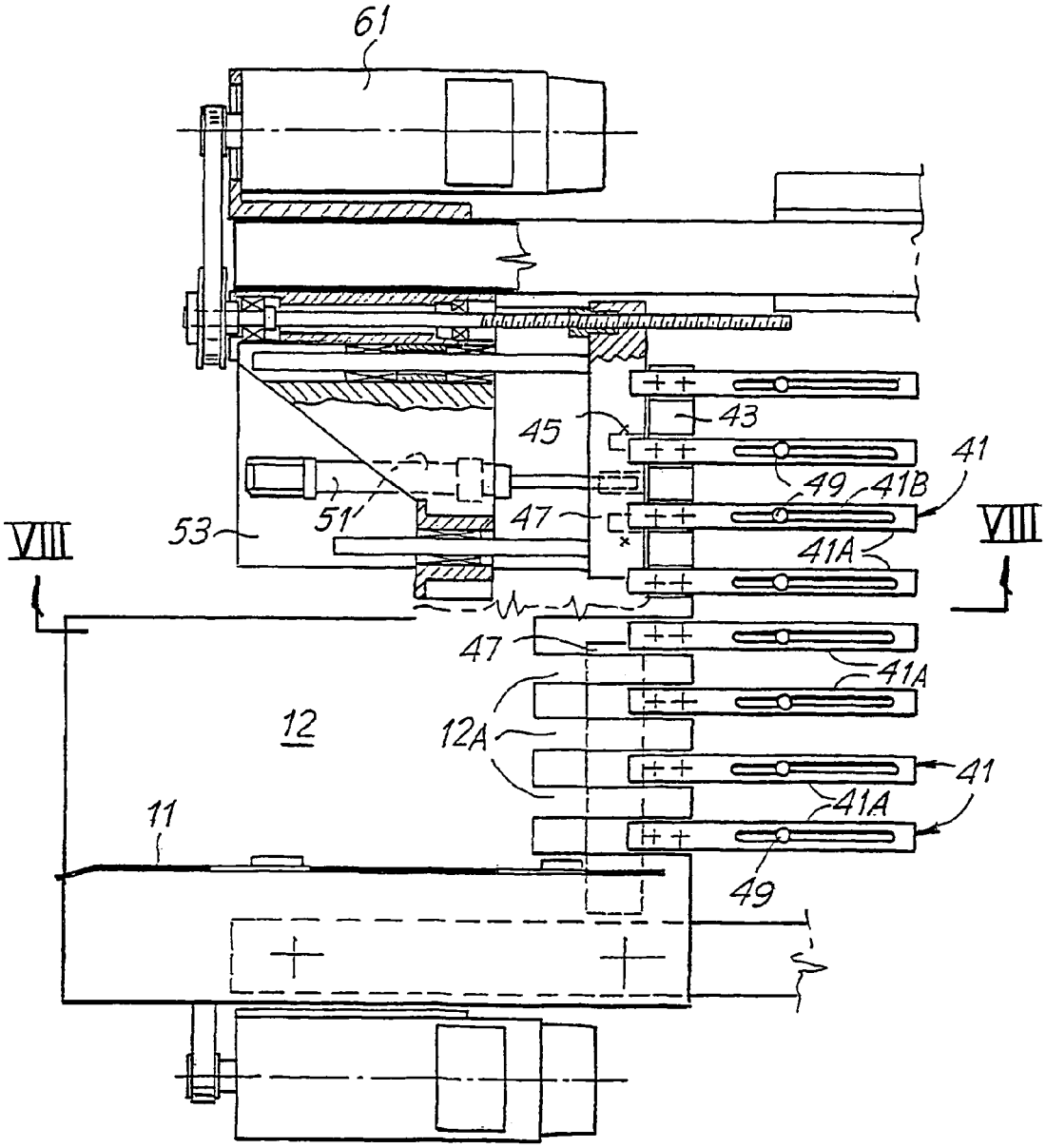
FIG. 7 is a plan view of the moving-surface system for turning over the packs of products.
Figure 8:
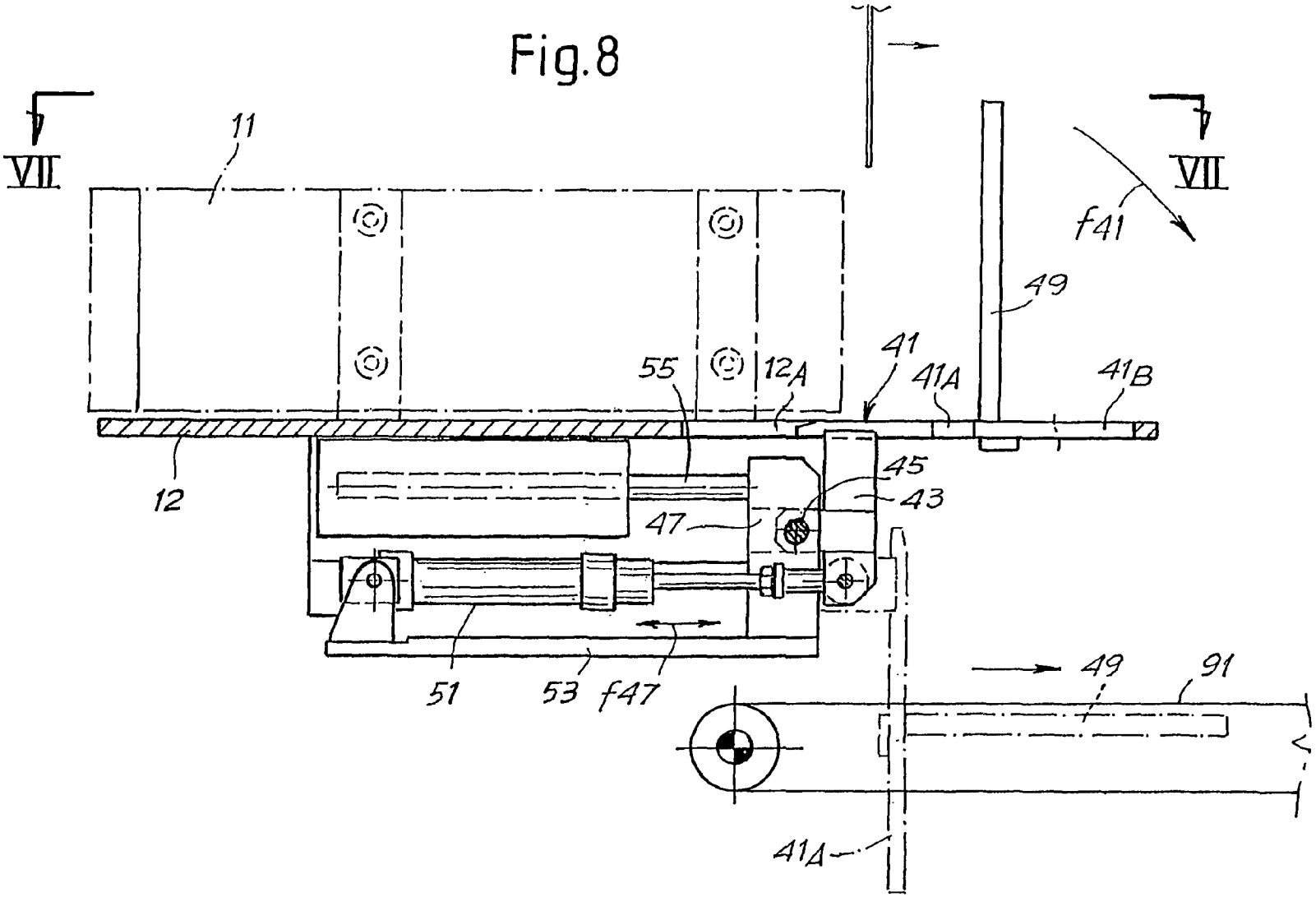
FIG. 8 is a section according to the plane indicated by VIII—VIII in FIG. 7.

The pile P, P1, P2 advances along a path of advance defined by a feed channel delimited by a pair of side walls 11 (see also FIGS. 5, 7 and 8) and by a bottom wall 12, at the end of which packs of serviettes M1, M2, . . . , Mn, each containing a pre-determined number of products, are unloaded.

Figure 3:
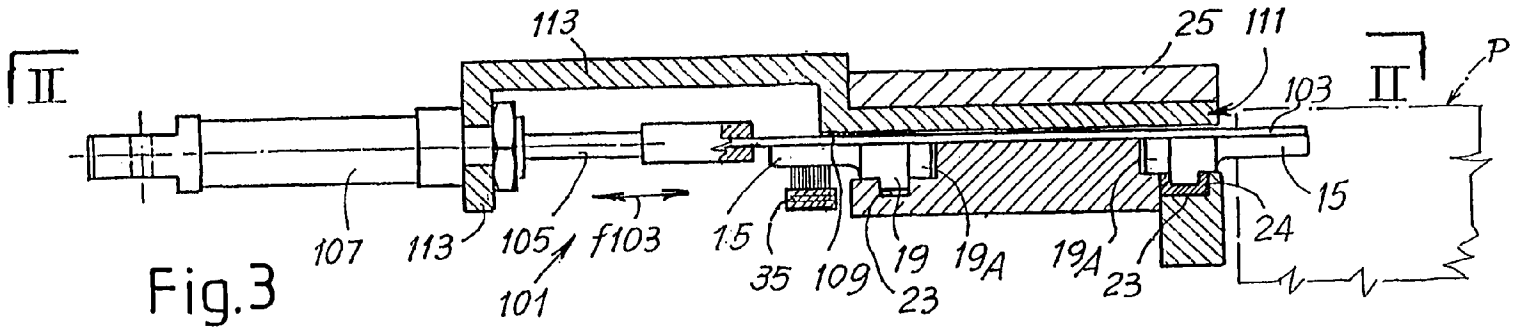
FIG. 3 is a section according to the plane indicated by III—III in FIG. 2.
Figure 2:
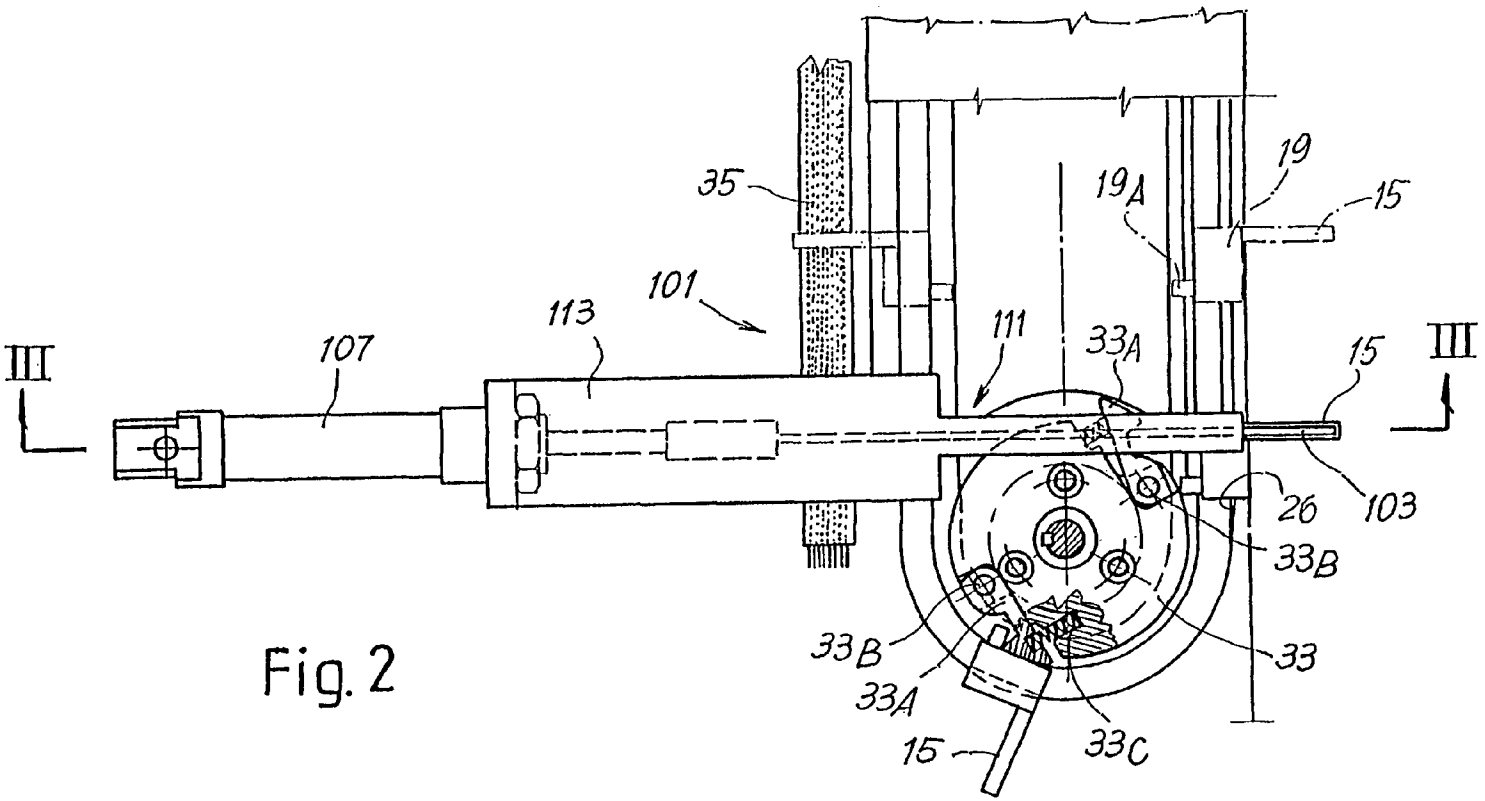
FIG. 2 is an enlarged plan view of the separator member, according to the plane indicated by II—II in FIG. 3.

To separate one pack of serviettes M1 from the next pack M2, at the sides of the feed channel for the pile P, P1, P2, two series of separator fingers 15 are set, one on each side of the channel. Each separator finger 15 is integral with a respective slider 19, which slides in a respective slide guide. The arrangement can be seen in particular in FIGS. 2 and 3. Set on each side of the feed channel for the pile P, P1, P2 is a corresponding slide guide 23, within which the sliders 19 of the separator fingers 15 slide, said slide guide being closed at the top by a plate 25 made of a material having a low coefficient of friction in order to enable easy sliding of the sliders 19. Each slide guide 23 has two rectilinear stretches which are radiused, in the vicinity of the folding rollers and in the vicinity of the area for unloading the packs of folded products, by arched end portions.

The slide guide 23 houses, inside it and along the internal rectilinear stretch, i.e., the one closest to the feed channel for the pile of serviettes, a drive belt 24 with a U-shaped cross section which defines a seat of engagement for bottom teeth 19X provided on the sliders 19. The belt has a speed of advance that can be adjusted and is approximately equal to the speed of advance of the pile P of products in order to control movement of advance of the fingers 15 and of the sliders 19.

Alternatively, the belt 24 may not be present, and the sliders 19 can engage directly in a fixed slide channel having a low coefficient of friction, which forms the slide guide 23. In this case, advance of the sliders is obtained by means of the thrust exerted by the pile of folded products.

Each slider is moreover provided with a rear appendage 19A for the purposes that will be described hereinafter.

The guides 23 define a closed path, and in each one of the guides 23 there is preferably set an equal number of sliders 19, so that on each side of the feed channel there corresponds, to each slider 19 and to the associated finger 15 in the guide 23, a slider 19 and an associated finger 15 in the guide 23 on the opposite side of the feed channel for the folded products.

In an area corresponding to the two arched end areas of each guide 23 there are present a respective first grooved spool 31 (in the vicinity of the respective folding roller 1, 3) with a series of longitudinal grooves 31A, and a second spool 33 (in the unloading area).

Two hooks 33A are hinged to each spool 33 (see, in particular, FIG. 2) about axes parallel to the axis of rotation of the spool 33, said hooks being elastically loaded by springs 33C so that they will protrude from the periphery of the spool 33. The hooks 33A engage each slider 19 by means of the appendages 19A of the latter, which are provided on the rear part (i.e., the part opposite to the separator fingers 15) of each slider 19.

With the above arrangement, the stepwise rotation in a clockwise direction, indicated by the arrow f31, of the first grooved spool 31 causes hooking of the rear appendages 19A of the sliders 19 by the grooves 31A, and hence transfer of the sliders 19 from the respective external rectilinear stretch of the guide 23 to the internal rectilinear stretch, i.e., the stretch facing the pile P of products. Stepwise rotation of the grooved spool 31 can be obtained using any suitable system, for instance, using a free-wheel mechanism operated by a linear cylinder-piston actuator, or else using a rotary actuator. Likewise, stepwise rotation of the second spool 33 in the direction indicated by the arrow f33 causes hooking and transfer of the sliders 19 and of the fingers 15 that are integral with them from the internal rectilinear stretch to the external rectilinear stretch of the respective guide 23.

On each side of the feed channel for the pile P, P1, P2 of products and parallel to the external rectilinear stretch of each guide 23 a continuous flexible member 35 develops, which is run over two pulleys and which is provided with bristles that engage the fingers 15 transferred by the second spool 33 onto the external rectilinear stretch of the respective guide 23 and draw them along in the direction indicated by the arrow f35, in a direction opposite to the direction of advance of the pile P, P1, P2 of products. The sliders 19 are carried by the flexible member 35 until they come into contact with the first spool 31, as may be seen in FIG. 1. A number of fingers 15 are piled up against the spool 31, whilst the flexible member 35 can slide beneath them by deformation of the bristles with which this member is equipped. At each rotation of the first spool 31 the fingers piled against it are pushed by the member 35 so that they remain in contact with the spool itself. The number of fingers 15 waiting, which are set up against the spool 31, depends upon the size of the packs of products M1–Mn being formed: the larger the size of each individual pack, the greater the number of pairs of fingers 15 waiting.

In the vicinity of the end area (i.e., the one furthest away from the folding rollers 1, 3) of each guide 23 there is set a separating member generically designated by 101, which does not translate in the direction of advance of the pile of products and which is provided with a transverse movement of insertion and extraction with respect to the pile itself. This movement, as will emerge clearly from what follows, is synchronized with the movement of the separator fingers 15 to enable temporary withholding, separation and unloading of each pack of products.

Each separating member 101 (see in particular FIGS. 2 and 3) comprises a stem 103 integral with the rod 105 of a cylinder-piston actuator 107, which governs the reciprocating movement indicated by the double-headed arrow f103 of the stem 103 itself. In its own movement, the stem 103 is guided in a groove 109 made in a supporting element 111 that is fixed with respect to the guide 23, integral with an appendage 113 of which is the cylinder-piston actuator 107.

The operation of the device so far described is as follows.

The folding rollers 1 and 3 rotate continuously to form the pile P, which is then cut by the blade 9 into the two parts P1, P2. In this step, in a position adjacent to each roller 1 and 3 there is waiting a respective separator finger 15, which remains stationary outside the folding area. When a pre-set number of folds has been reached, which will give rise to a pre-set number of serviettes as a result of the cutting operation performed by the blade 9, on each side of the machine the respective grooved spool 31 rotates by one step, so bringing the slider 19, and consequently the respective separator finger 15, from the extracted position external to the folding rollers in the folding area, into a position that is more advanced with respect to the point in which the subsequent fold of the weblike material N is formed. This movement is made possible by the presence of annular grooves in the folding rollers 1 and 3. The sliders 19 are totally released from the grooved spool 31 and are inserted with their bottom appendages 19X into the respective longitudinal seats of the belts 24 set in the guides 23, along the stretch of path facing the feed channel.

As feeding of the weblike material N continues, and hence folding thereof with accumulation of material folded into the pile P, the two fingers 15 on the two sides of the feed channel, drawn along by the respective grooved spools 31 into the active area of folding, remain engaged between one fold and the next, and start to advance along the guides 23, being pushed by the pile P, P1, P2 itself of products that are advancing as a result of the action of the arms 7, aided therein by the action of the respective drive belts 24, the speed of advance of which (as has been said previously) is approximately equal to the speed of advance of the pile P.

Figure 4B:
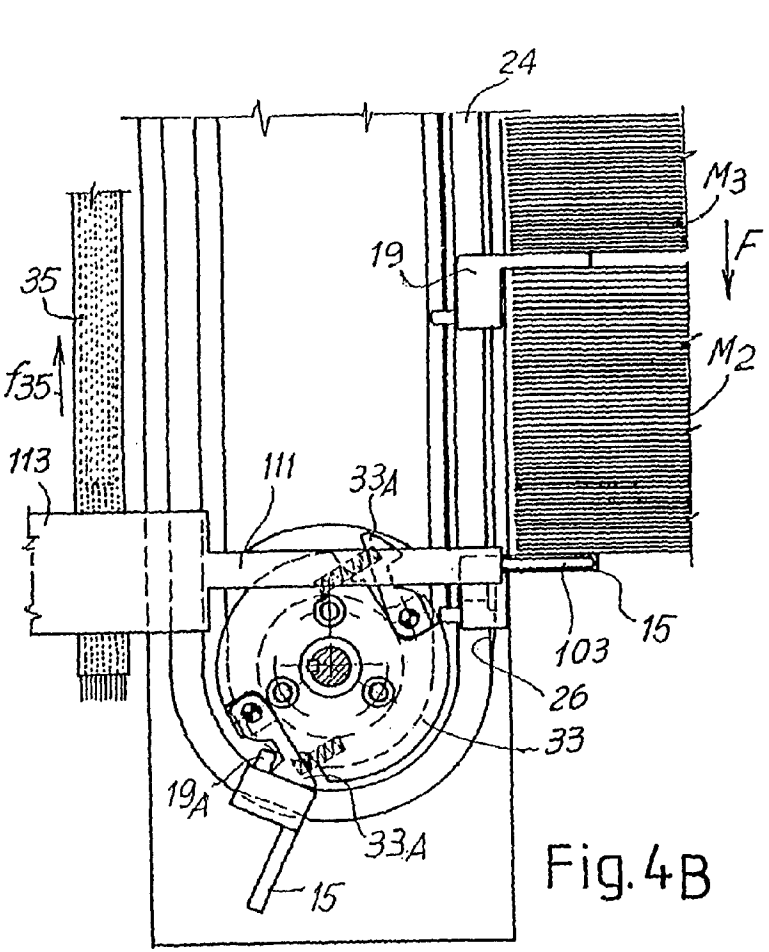
FIGS. 4A–4D are plan views of the area for unloading the folded products in four distinct steps of the unloading operation.
Figure 4A:
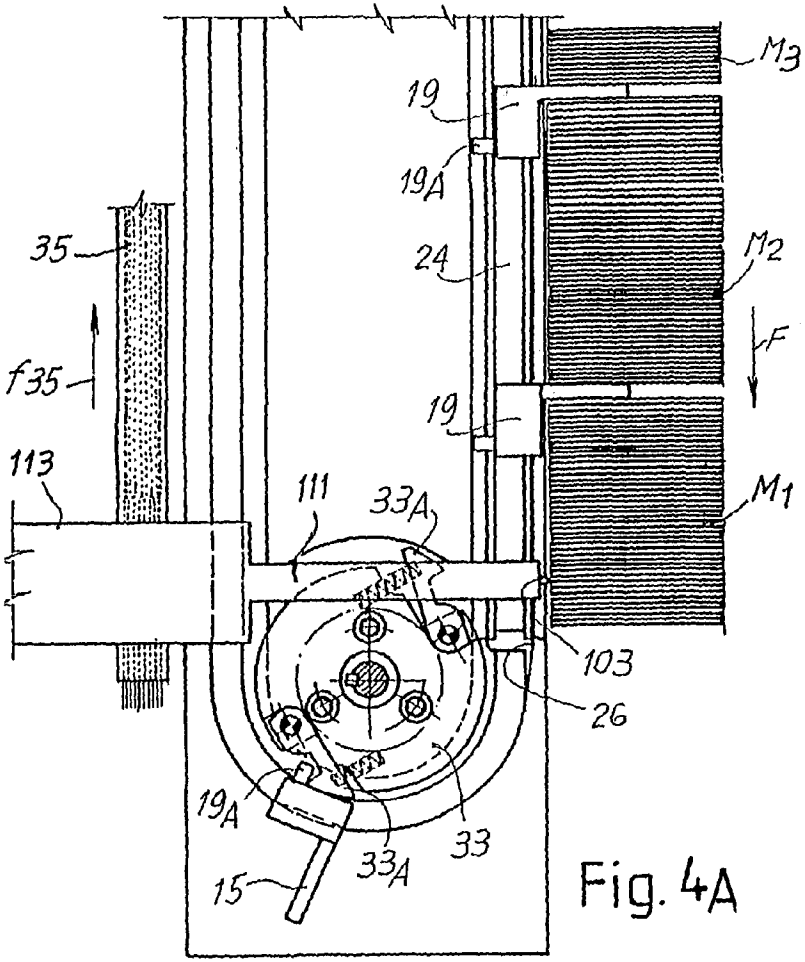

When the two sliders 19 on the two sides of the feed channel of the pile P, P1, P2 reach the end of the rectilinear stretch of the guides 23, the first group of laminar products or serviettes M1 is separated from the next group M2 by means of the pair of separator fingers 15 and by the separating members 101 in the way illustrated in FIGS. 4A–4D, where one side of the feed channel for the pile of serviettes is shown, R being understood that on the opposite side a symmetrical arrangement of members carries out a symmetrical succession of movements. In FIG. 4A, a separator finger 15 is set between two packs M1 and M2 of products and advances together with these in the direction indicated by the arrow F. The stem 103 is in the extracted position, i.e., retracted underneath the support 111.

In FIG. 4B the separator finger 15 set between the packs M1 and M2 is aligned with the stem 103 of the separating member 101, which has been timely extracted by the cylinder-piston actuator 107 to be inserted into the gap between the two successive packs M1 and M2, which are slightly divaricated thanks to the presence of the separator finger 15. As may be seen in FIG. 4C, the-spool 33 is now rotated by a first angle so as to hook, by means of one of its hooks 33A, onto the rear appendage 19A of the slider 19, with which the finger 15 set between the packs M1 and M2 is integral, and to move the slider 19 itself away through an angle from the position in which the stem 103 is situated. During this step, the hook 33A is made to go back in, overcoming the force of the spring 33C in such a way that the slider 19 and the finger 15 can approach the axis of rotation of the spool 33 so as to be released more easily from the pack of serviettes. The thrust is obtained by means of an inclined radiusing profile 26, which acts on the slider 19.

The second hook 33A carried by the spool 33 undergoes a similar rotation, and in this way brings a slider 19, previously removed from the area of unloading of the serviettes, up to the external rectilinear branch of the guide 23, along which it is drawn until it reaches the grooved spool 31 again, so that it can be re-used. Return of the sliders 19 along the external rectilinear branch of the guide 23 is obtained by means of a flexible member 35 in a way in itself known.

Figure 4D:
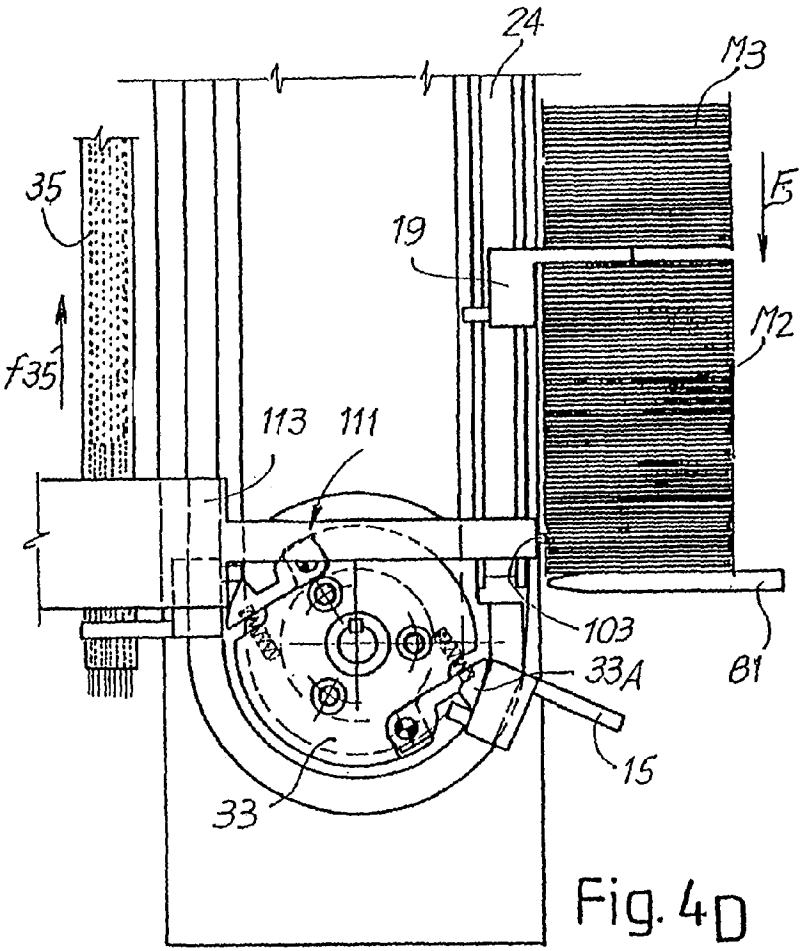
Figure 4C:
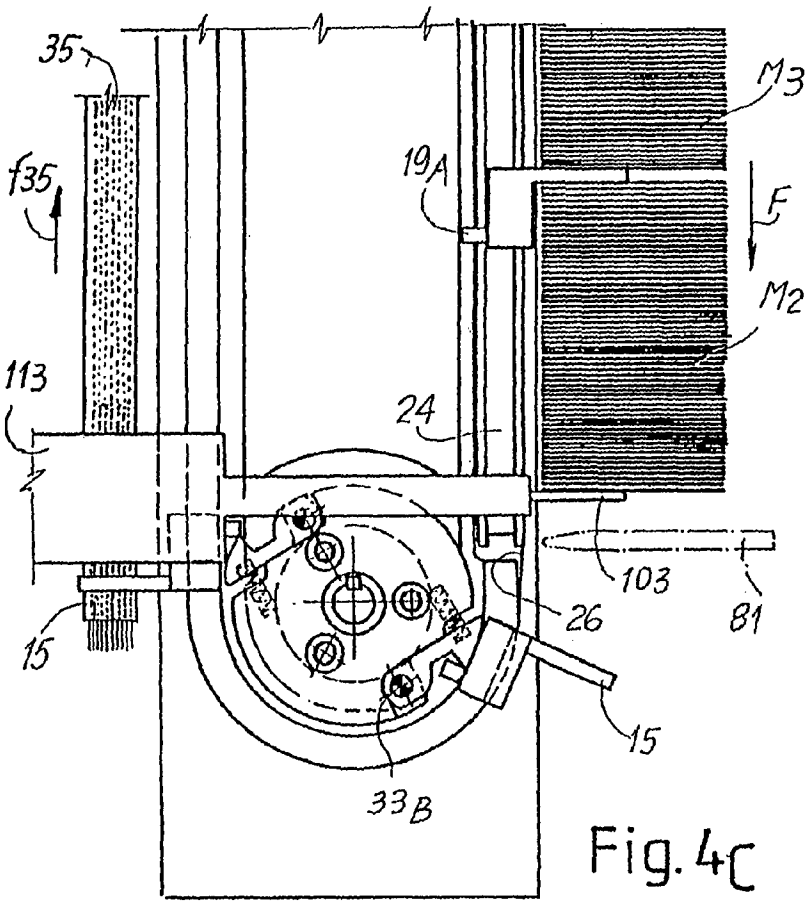
Figure 5:
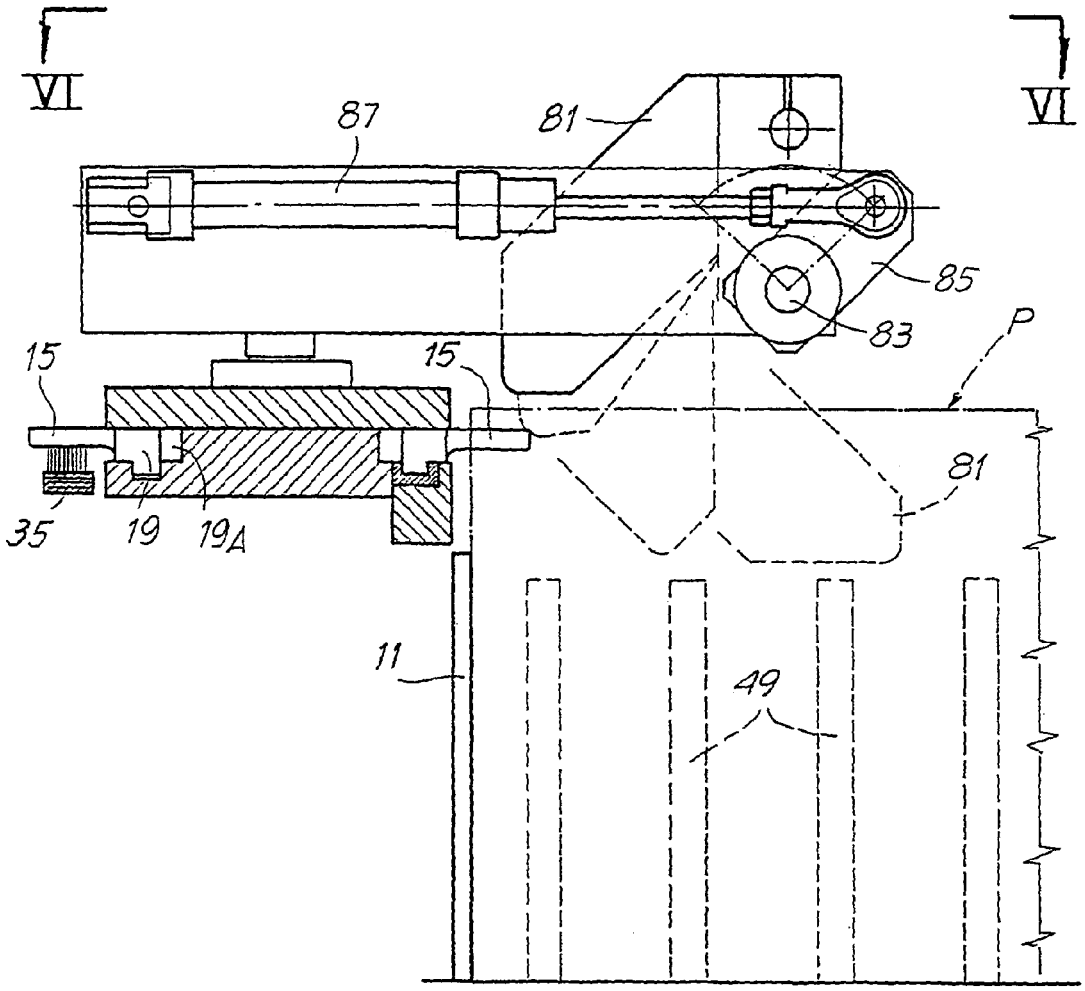
FIG. 5 is a front view of the retention blade for holding back the packs of products.

FIG. 4D shows a further step (which can partially overlap the previous step) in which the stem 103 has been retracted after a blade 81 or other suitable front-retention member of the pile has been inserted in the path of advance of the pile of serviettes. The mechanism for insertion of the blade 81 is illustrated in FIG. 5 and will be described in greater detail in what follows. In this way, the front of the pile of serviettes is withheld by the blade 81, which, as will be described hereinafter, advances along the path of advance of the serviettes, and the stem 103 can move back, so releasing the pile of serviettes. The blade 81 advances until it accompanies the front of the pile of products against a vertical contrast surface which also has the function of containing the products and forms part of the means for turning over and unloading the individual packs of products by oscillating about a horizontal axis orthogonal to the direction of advance of the pile of products. The purpose of the oscillating movement is to unload the individual pack of products onto an underlying conveyor, as described in what follows.

The means for turning over and unloading the individual packs M1, M2, . . . , Mn of products separated by means of the separator fingers and the stems 103 are illustrated in particular in FIGS. 5–8, and are basically equivalent to the ones described in detail in WO-A-9728076, the content of which is incorporated in the present description.

The wall 12 defining the bottom of the feed channel for the pile P, P1, P2 ends with a comb-like portion 12A, which co-operates with a moving surface 41 defined by a plurality of laminas 41A carried by a bracket 43 articulated in 45 to a block 47. Each lamina 41A has a slot 41B within which there engages, in an adjustable position, a bar 49 which is orthogonal to the surface 41. The bars 49 are aligned together to define the aforesaid vertical contrast surface, which also has the function of containing the pile of products.

The surface 41 formed by the laminas 41A can be turned over about the horizontal axis 45 by means of a cylinder-piston actuator 51. In addition, the block 47, with the plate 53, the actuator 51, and the surface 41, can translate according to the double-headed arrow f47 by means of a mechanism illustrated in FIG. 7 (in itself known and not described in greater detail herein), which comprises an actuator 61.

Figure 6:
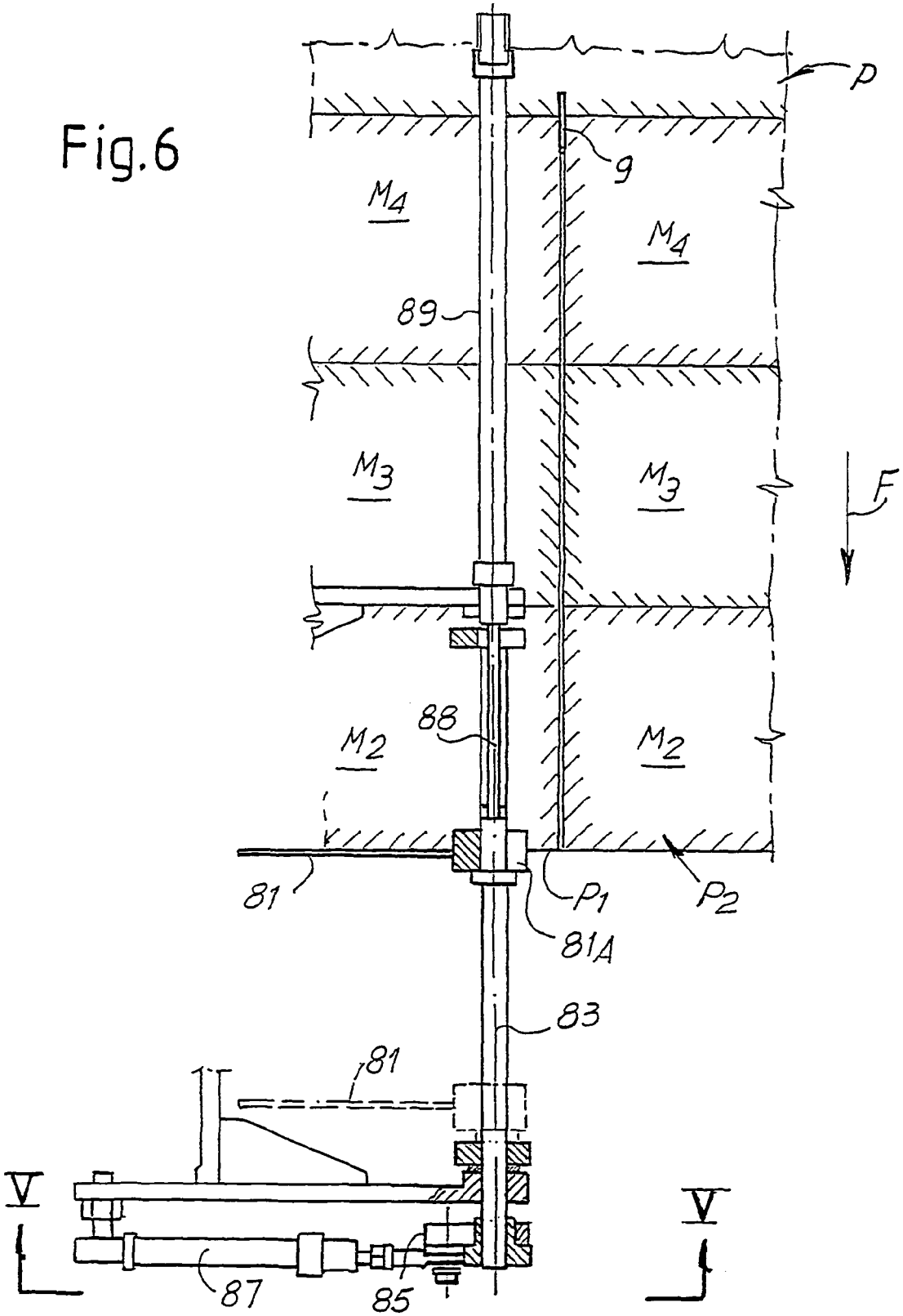
FIG. 6 is a view according to the plane indicated by VI—VI in FIG. 5.

Set above the surface 41 is the blade 81, operated, for example, by means of a mechanism illustrated in isolation, in particular in FIGS. 5 and 6. The blade 81 is constrained to a spindle 83 which develops parallel to the direction of advance F of the pile P, P1, P2 of products in such a way as to oscillate integrally with the spindle itself about the axis of the latter. The spindle 83 is constrained by means of an arm 85 to a cylinder-piston system 87 which controls oscillation of the spindle about its own axis in order to cause, in this way, oscillation of the blade 81 between a top position, which is extracted with respect to the pile P, P1, P2 (indicated by the solid line in FIG. 5) and a bottom position (indicated by a dashed line in FIG. 5), in which the pile of products rests on the blade itself.

The support 81A of the blade (FIG. 6) is in addition constrained to the stem 88 of a further cylinder-piston actuator 89, which displaces the blade 81 in a direction parallel to the direction of advance F of the pile P.

The arrangement now described is symmetrical, there being provided a pair of blades 81 set alongside one another, one in a position corresponding to each portion P1, P2 of the pile of products coming from the machine.

The operations of unloading packs of products take place as described below.

The bars 49 are brought initially into the position where they are closest to the folding rollers 1 and 3, and the most advanced products in the pile P, P1, P2 rest on the bars 49 and are pushed against them. As the weblike material N is folded and the serviettes are formed by the rollers 1, 3 and by the blade 9, the bars 49 translate under the control of the motor 61 to provide room for the new products coming from the machine.

A sensor (not shown) emits a signal when a pair of fingers 15 reaches the position of FIG. 4A. This signal represents enabling for start of the cycle for unloading of the pack M1 of serviettes, which takes place as described in what follows. The stems 103 are inserted in the gap between adjacent packs separated by the fingers 15 in the most advanced position along the product-feed channel. The fingers 15 and the sliders 19 that are integral with them are moved away by rotation of the spools 33. The blade 81 is lowered and penetrates into the empty space thus created. The entire process corresponds to the one already described with reference to FIGS. 4A–4D. The surface 41 is rotated through 90° by the cylinder-piston actuator 51 in order to tip the pack M1 onto a conveyor 91 (FIG. 8) consisting of a plurality of parallel belts, between which the laminas 41A and the corresponding bars 49 pass.

The next pack M2 is withheld at the front by the stems 103 and then by the blade 81 after the latter has been inserted with a movement about the axis of the stem 88.

Once the pack M1 has been deposited on the conveyor 91 and has been removed from the unloading area by means of the conveyor 91 itself, the surface 41 is raised up again by means of the cylinder-piston actuator 51, whilst the actuator 61 causes the ensemble 41, 43, 47, 49 to move back to a position in which the bars 49 come into contact with the front surface of the pack M2. This position is determined by the PLC which controls the actuator 61 according to the values of thickness of the weblike material N and the rate of production, in so far as, in the meantime, the blade 81 is pushed forwards under the thrust of the pile of products to enable continuous operation of the folding machine without substantial increase in the compression of the products. Before the surface 41 and the bars 49 return to the position in which they are resting against the advancing pile, the fingers 15 are extracted by the spools 33 (FIG. 4D), so that the pack M2 is withheld in the last step by just the blade 81, which is free to advance under the thrust of the pile P, extracting the stem of the cylinder-piston system 89.

When the bars 49 are again in contact with the first serviette of the advancing pile, the blade 81 is slid out upwards by means of the actuator 87 and is then retracted into the initial position by means of the actuator 89.

As may be seen in the attached figures, the actuators and devices that enable unloading of the packs of products are double and symmetrical, in so far as the unloading of the packs M1 from the two portions P1 and P2 into which the pile P has been cut cannot take place simultaneously.

In the embodiment so far described, the stem 103 of the separating member 101 describes a movement orthogonal to the direction of advance of the products and substantially parallel to the axis of the stem itself. In certain cases, it may be convenient for the stem 103 to be inserted between adjacent packs of products in a position as close as possible to the position in which the separator finger is located. This is convenient, for example, when the products are made of very compliant material which tends to close immediately onto the separator fingers without leaving sufficient space for insertion of the stem 103.

In such a case, it may be envisaged that the separator fingers 15 and the sliders 19 have a guide groove within which the stem 103 slides during its movement of insertion between adjacent packs of products. Once the end of the stem 103 is inserted between the consecutive packs of products, the stem 103 can be raised to be released from the slider 19 and from the finger 15.

Figure 9A:
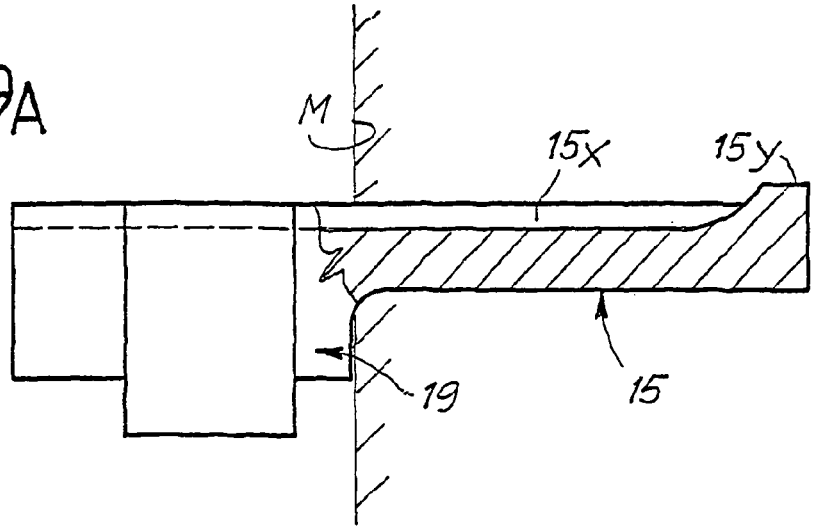
FIGS. 9A–9C show a modified embodiment of the separator fingers and their operation.
Figure 9B:
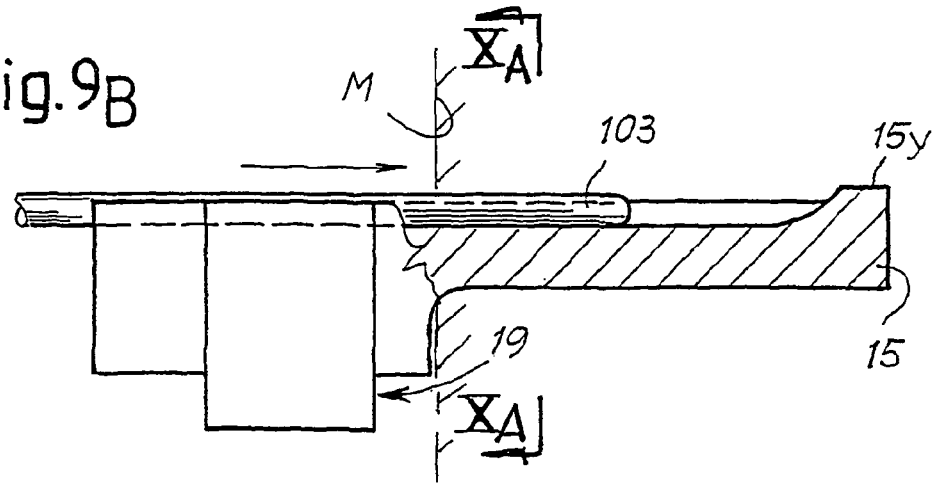
Figure 9C:
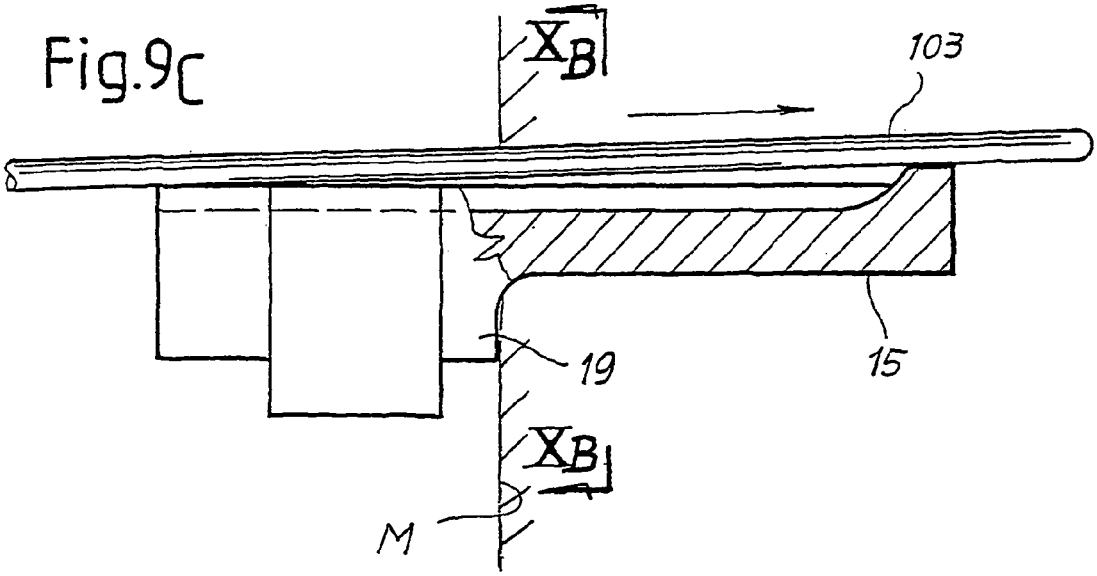
Figure 10A:
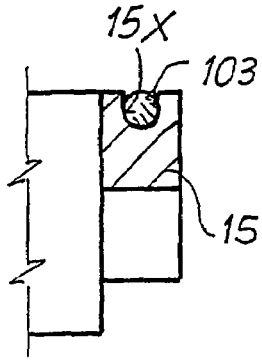
FIGS. 10A and 10B show sections respectively according to the plane indicated by X—X in FIG. 9B and in FIG. 9C.
Figure 10B:
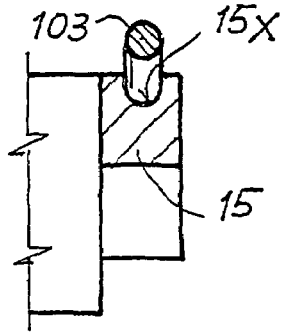

One way to obtain this movement may be that of appropriately shaping the finger 15, as illustrated in FIGS. 9A–9C and 10A, 10B, where also the stem 103 is represented in different positions during the movement of insertion. FIG. 9A illustrates the slider 19 with the separator finger 15 integral with it, partially sectioned to show the guide groove 15X. The guide groove 15X ends with a curved area for connection to a projecting toothlike end portion or toe 15Y. FIGS. 9B and 9C illustrate how the stem 103 is guided along the groove 15X until it encounters with its end the curvature of radiusing. Continuation of the movement of advance of the stem causes it to climb up the end portion or toe 15Y and hence, in practice, causes raising of the stem 103, which is thus released from the guide groove 15X, as shown in FIG. 9C. In this position, the separator finger 15 can be removed by the spool 33 in the way described above, whilst the stem 103 remains up against the second pack of folded products. FIGS. 10A and 10B show the cross section according to the plane indicated by X—X of FIGS. 9B and 9C, respectively.

The movement of raising of the stem 103 can be obtained by bending of the stem itself, or else also by the stem being mounted, together with the corresponding actuator 107, so that it can oscillate in a vertical plane.

The possibility is not ruled out of the movement of raising the stem 103 with its consequent release from the guide groove 15X taking place in a different way, for example by means of a further actuator, or else by means of a cam profile which is outside the area of the finger 15 and the slider 19.

The return path of the separator fingers can develop on different levels so as to prevent collision of the fingers with the stem 103 in the return step. Alternatively, the stem 103 can be appropriately shaped with a double Z-like curvature, with the distal area at a lower level corresponding to the level of the separator fingers 15 to be inserted between the adjacent packs of products, whilst the proximal area with respect to the actuator 107 is at a higher level so as not to interfere with passage of the fingers 15 in the return path.

Figure 11:
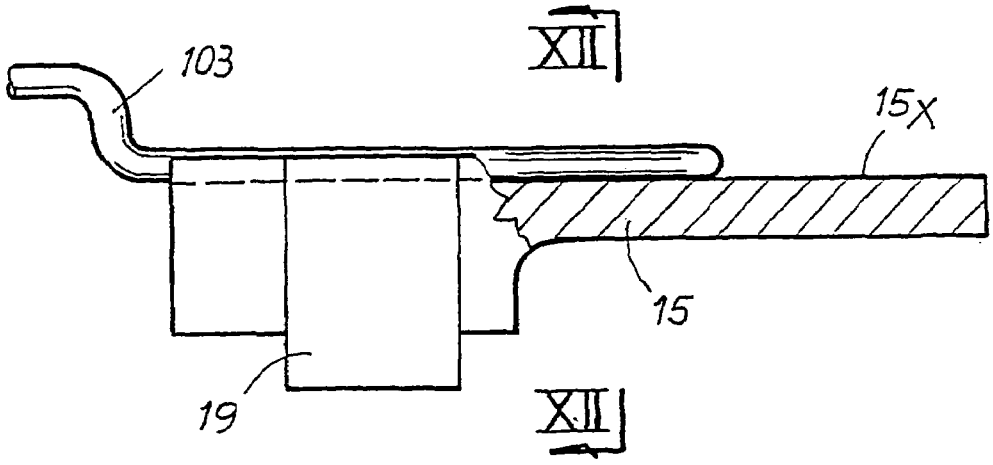
FIGS. 11 and 12 show a further embodiment, FIG. 12 being a section according to the plane indicated by XII—XII in FIG. 11.
Figure 12:
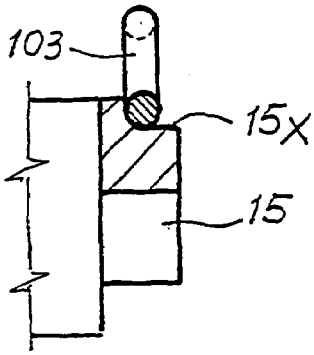

When a lifting movement of the stem 103 is not required, its insertion in the gap between adjacent packs of products in a position corresponding to the overall dimensions of the separator finger 15 can be obtained also with a different shaping of the finger itself, as illustrated in FIGS. 11 and 12. In this case, the top surface of the separator finger 15 is shaped in steplike fashion. The step again forms a groove 15X for guiding the stem, even though it is open on one side. The stem 103 is inserted in the lowered area of the separator finger. The separator finger 15 can move away after insertion of the stem 103 without the latter moving vertically thanks to the steplike shape of the finger itself, the movement of advance of which is indicated by the arrow in FIG. 12. FIG. 11 also shows a possible Z-like shaping of the stem 103.

It is understood that the drawings only provides an illustrative example furnished purely by way of practical demonstration of the invention, given that the invention may vary in its embodiments and arrangements without thereby departing from the scope of the idea that underlies the invention itself. The possible presence of reference numbers in the attached claims has the purpose of facilitating reading thereof with reference to the description and to the drawings, and in no way limits the scope of protection represented by the claims.

The invention claimed is:

1. A device for dividing a pile of laminar products into packs and for separating said packs from one another, comprising:

a path of advance of said pile of laminar products;

a plurality of individual separator fingers;

at least one guide along said path of advance defining a closed path for said plurality of individual separator fingers with an advance stretch and a return stretch, at least the advance stretch being substantially parallel to the path of advance of said pile of laminar products; and at least one separating member constructed and arranged to include a movement of insertion and extraction with respect to said pile of laminar products set in a vicinity of an end of said advance stretch of said guide, said movement being synchronized with a movement of advance of said laminar products along said path of advance, in such a way that said separating member inserts itself between a contiguous first pack and a second pack of laminar products, between which a single separator finger of said plurality of individual separator fingers is inserted, and said separating member temporarily withholds the pile of laminar products while said single separator finger is moved further along said path of advance to thereby move said first pack away from said second pack followed by removal of said single separator finger from between said first pack and said second pack; wherein said separating member has a stem that inserts between said contiguous first pack and said second pack of laminar products in a position corresponding to said single separator finger set between said first pack and said second pack; and, wherein each separator finger of said plurality of individual separator fingers has a guide groove therein for guiding said stem, said guide groove being orthogonal to said direction of advance of the first pack and the second pack.

2. The device according to claim 1, wherein said separator finger is constructed to raise said stem from said guide groove to release said stem from said guide groove.

3. The device according to claim 2, wherein said guide groove is shaped in such a way as to raise said stem in an end part of travel of insertion of said stem between said contiguous first pack and said second pack of laminar products.

4. The device according to claim 1, wherein said each separator finger has a stepped groove to enable extraction of said each separator finger when said separating member has penetrated between said contiguous first pack and said second pack of laminar products in a position corresponding to said stepped groove.

5. A method for separating adjacent packs of laminar products from one another, comprising:

inserting a single separator finger of a plurality of individual separator fingers between a contiguous first pack and a second pack of laminar products at an insertion area wherein said separator finger travels along a closed path of advance;

advancing said single separator finger along a path of advance of said laminar products;

moving said first pack of laminar products away from said second pack;

temporarily inserting at least one separating member between said first pack and said second pack before said first pack is separated from said second pack, and wherein said first pack is moved away from said second pack by continuing to move said single separator finger along said path of advance of said laminar products and then removing said single separator finger from between said first pack and said second pack, said second pack being temporarily withheld by said separating member;

unloading said first pack at an unloading area;

moving said single separator finger away from said path of advance of said laminar products; and moving said single separator finger from said unloading area to said insertion area, wherein said separating member is near said unloading area; wherein said separating member is guided in a groove present in said single separator finger.

6. The method according to claim 5, wherein said separating member is raised in an orthogonal direction to a direction of advance of said first pack and said second pack at an end of insertion between said first pack and said second pack of laminar products.

7. A device for dividing a pile of laminar products into packs and for separating said packs from one another, comprising:

a path of advance of said pile of laminar products;

a plurality of separator fingers;

at least one guide along said path of advance defining a closed path for said plurality of separating fingers with an advance stretch and a return stretch, at least the advance stretch being substantially parallel to the path of advance of said pile of laminar products;

a front-retention member movable in a direction substantially parallel to a direction of advance of said laminar products along said path of advance, said front-retention member being insertable in and extractable from said path of advance;

at least one separating member arranged in a side position adjacent said path of advance, substantially in a vicinity of an end of said path of advance, and said at least one separating member being constructed and arranged to include a movement of insertion from said side position into said path of advance, said movement of insertion being synchronized with a movement of advance of said laminar products along said path of advance, such that said separating member is inserted between a contiguous first pack of laminar products and a second pack of laminar products, between which a separator finger of said plurality of separator fingers is inserted, wherein said front-retention member is controlled to be inserted between said first pack of laminar products and said second pack of laminar products, after said separating member has been introduced between said first pack and said second pack; said front-retention member retaining said second pack and advancing therewith along said path of advance.

8. The device according to claim 7, wherein said separating member is arranged upstream of said end of said advance stretch of said guide.

9. The device according to claim 7 or 8, wherein said separating member is provided with a movement substantially orthogonal to said movement of advance of said pile of laminar products along said path of advance and is fixed in a direction of advance of said pile of laminar products.

10. The device according to claim 7 or 8, wherein said separating member has a stem that inserts between said contiguous first pack and said second pack of laminar products in a position corresponding to said separator finger set between said first pack and said second pack.

11. The device according to claim 7 or 8, wherein said separating member co-operates with said front-retention member, said separating member being inserted between said contiguous first pack and said second pack of laminar products for creating a gap for insertion of said front-retention member and being removed from said path of advance after said front-retention member has been inserted in said path of advance.

12. The device according to claim 7, wherein said at least one guide is positioned on each side of said path of advance, wherein each of said at least one guide has a plurality of said individual separator fingers which are mobile, and wherein each guide has a respective separating member.

13. A folding machine comprising:

a pair of folding rollers;

a strip of web material folded in zigzag fashion between said pair of folding rollers;

a blade which divides the zigzag-folded material into two portions; and a device for dividing a pile of laminar products according to claim 7 or 8.

14. The device according to claim 7, further comprising a finger transfer device for transferring each separator finger from said advance stretch to said return stretch, said transfer device being arranged substantially in the vicinity of said end of the path of advance; and wherein said side position of said separating member is arranged adjacent said finger transfer device.

15. The device according to claim 14, wherein said transfer device is controlled to move said separator finger away from said second pack while said separating member temporarily retains said second pack; said front-retention member being inserted between the second pack and the first pack which has been thus moved away from said first pack.

16. A device for dividing a pile of laminar products into packs and for separating said packs from one another, including:

a path of advance of said pile of laminar products;

a plurality of separator fingers;

at least one guide along said path of advance defining a closed path for said plurality of separator fingers with an advance stretch and a return stretch, at least the advance stretch being substantially parallel to the path of advance of said pile of laminar products;

a front-retention member movable in a direction substantially parallel to a direction of advance of said laminar products along said path of advance, said front-retention member insertable in and extractable from said path of advance;

at least one separating member movable into said path of advance from a side position arranged laterally adjacent said path of advance, substantially in a vicinity of an end of said path of advance, wherein said front-retention member is movable back and forth from a position substantially level with said side position of said separating member to a contrast surface of a pack unloading device.

17. The device according to claim 16, further comprising a finger transfer device for transferring each separator finger from said advance stretch to said return stretch, said transfer device being arranged substantially in the vicinity of said end of the path of advance; and wherein said side position of said separating member is arranged adjacent said finger transfer device.

18. The device according to claim 17, wherein said transfer device is controlled to move said separator finger away from said second pack while said separating member temporarily retains said second pack; said front-retention member being inserted between the second pack and the first pack which has been thus moved away from said first pack.

19. The device according to claim 16, wherein said separating member is arranged upstream of said end of said advance stretch of said guide.

20. The device according to claim 16 or 19, wherein said separating member is provided with a movement substantially orthogonal to said movement of advance of said pile of laminar products along said path of advance and is fixed in a direction of advance of said pile of laminar products.

21. The device according to claim 16 or 19, wherein said separating member has a stem that inserts between said contiguous first pack and said second pack of laminar products in a position corresponding to said separator finger set between said first pack and said second pack.

22. The device according to claim 16 or 19, wherein said separating member co-operates with said front-retention member, said separating member being inserted between said contiguous first pack and said second pack of laminar products for creating a gap for insertion of said front-retention member and being removed from said path of advance after said front-retention member has been inserted in said path of advance.

23. A folding machine including:

a pair of folding rollers;

a web feed path passing through said folding rollers;

a path of advance for a web folded in zigzag fashion by said folding rollers to provide a zigzag-folded web material, arranged downstream of said folding rollers, said path of advance extending from said folding rollers towards an unloading end;

along said path of advance, a blade which divides the zigzag-folded web material into two portions;

adjacent each said folding rollers, a finger insertion device, which inserts separator fingers into said zigzag-folded web material;

guides along said path of advance defining a closed path for said plurality of separator fingers, said guides including an advance stretch substantially parallel to the path of advance of said pile of laminar products, and a return stretch;

a front-retention member movable in a direction substantially parallel to a direction of advance of said laminar products along said path of advance, between a first end position and a second end position, said first end position and said second end position being arranged downstream of said blade; said front-retention member insertable in and extractable from said path of advance; and at least one separating member arranged in a side position adjacent said path of advance, substantially in a vicinity of said unloading end, constructed and arranged to include a movement of insertion from said side position into said path of advance.

24. Folding machine according to claim 23, wherein the insertion of said separating member from said side position into said path of advance is synchronized with movement of advance of packs of laminar products formed by said zigzag-folded web material cut by said blade along said path of advance, in such a way that said separating member is inserted between a contiguous first pack and second pack of laminar products, between which a separator finger of said plurality of separator fingers is inserted.

25. Folding machine according to claim 24, wherein said front-retention member is controlled to be inserted between said first pack and said second pack of laminar products advancing along said path of advance, after said separating member has been introduced between said first pack and said second pack; said front-retention member retaining said second pack and advancing therewith along said path of advance.

26. A folding machine including:

a pair of folding rollers;

a web feed path passing through said folding rollers;

a path of advance for a web folded in zigzag fashion by said folding rollers to provide a zigzag-folded web material, arranged downstream of said folding rollers, said path of advance extending from said folding rollers toward an unloading end;

along said path of advance, a blade which divides the zigzag-folded web material into two portions;

adjacent each said folding rollers a finger insertion device, which inserts separator fingers into said zigzag folded web material;

guides along said path of advance defining a closed path for said separator fingers, said guides including an advance stretch substantially parallel to the path of advance of said pile of laminar products, and a return stretch;

a front-retention member movable in a direction substantially parallel to a direction of advance of packs of laminar products formed by said zigzag-folded web material cut by said blade, said front-retention member insertable in and extractable from said path of advance;

at least one separating member movable into said path of advance from a side position arranged laterally adjacent said path of advance, substantially in a vicinity of an end of said path of advance;

a pack unloading device including a contrast surface substantially orthogonal to the path of advance; wherein said front-retention member is movable back and forth from a position substantially level with said side position of said separating member to said contrast surface.

27. The device according to claim 26, further comprising a finger transfer device for transferring each separator finger from said advance stretch to said return stretch, said transfer device being arranged substantially in the vicinity of said end of the path of advance; and wherein said side position of said separating member is arranged adjacent said finger transfer device.

28. The device according to claim 27, wherein said transfer device is controlled to move said separator finger away from said second pack while said separating member temporarily retains said second pack; said front-retention member being inserted between the second pack and the first pack which has been thus moved away from said first pack.

29. A method for separating adjacent packs of laminar products from one another, comprising:

providing a path of advance for said packs of laminar products extending towards an unloading area;

arranging a separating member in a side position of said path of advance, substantially near said unloading area, said separating member being movable from said side position into said path of advance;

inserting a separator finger of a plurality of separator fingers between a first pack and a contiguous second pack of laminar products at an insertion area;

advancing said separator finger and said first pack and said second pack along a path of advance of said laminar products toward said unloading area;

when said separator finger reaches said side position, temporarily inserting said separating member between said first pack and said second pack before said first pack is separated from said second pack;

moving said first pack away from said second pack by continuing to move said separator finger along said path of advance, said second pack being temporarily withheld by said separating member;

inserting a front-retention member between said first pack and said second pack to frontally support said second pack;

removing said separator finger from said path of advance and inserting said separator finger in a return path, and withdrawing said separating member from said path of advance into said side position.

30. A method for producing packs of folded laminar products, comprising:

feeding a web material between first and second rotating folding rollers;

folding said web material in a zigzag fashion to provide a zigzag-folded web material;

introducing separator fingers between pre-set numbers of folds in said zigzag-folded web material;

advancing said zigzag-folded web material along a path of advance;

cutting said zigzag-folded web material in an intermediate region along said path of advance forming two piles of packs of folded laminar products, adjacent packs being separated by separator fingers, and advancing said laminar products towards an unloading area;

arranging a separating member in a side position of said path of advance, substantially near said unloading area, said separating member being movable from said side position into said path of advance;

when one of said separator fingers reaches said side position, temporarily inserting said separating member between a first pack and a second pack, between which said finger is arranged, before said first pack is separated from said second pack;

moving said first pack away from said second pack by continuing to move said separator finger along said path of advance, said second pack being temporarily withheld by said separating member;

inserting a front-retention member between said first pack and said second pack to frontally support said second pack;

removing said separator finger from said path of advance and inserting said separator finger in a return path, and withdrawing said separating member from said path of advance into said side position.

* * * * *